US009623692B2

(12) United States Patent
Kataoka et al.

(10) Patent No.: US 9,623,692 B2
(45) Date of Patent: Apr. 18, 2017

(54) PRINTING APPARATUS

(71) Applicant: SEIKO EPSON CORPORATION, Tokyo (JP)

(72) Inventors: Hideyuki Kataoka, Shiojiri (JP); Takahiro Abe, Shiojiri (JP); Hiroyuki Kobayashi, Shimosuwa-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/161,890

(22) Filed: May 23, 2016

(65) Prior Publication Data

US 2016/0347104 A1 Dec. 1, 2016

(30) Foreign Application Priority Data

May 25, 2015 (JP) ..... 2015-105428

(51) Int. Cl.

| | |
|---|---|
| ***B41J 29/393*** | (2006.01) |
| ***B41J 11/00*** | (2006.01) |
| *B41J 2/17* | (2006.01) |

(52) U.S. Cl.

CPC ..... *B41J 29/393* (2013.01); *B41J 2/1721* (2013.01); *B41J 11/0065* (2013.01); *B41J 11/0095* (2013.01); *B41J 2002/1742* (2013.01)

(58) Field of Classification Search

CPC .. B41J 11/0095; B41J 2/1721; B41J 11/0065; B41J 2002/1742

See application file for complete search history.

(56) References Cited

U.S. PATENT DOCUMENTS

2014/0132687 A1 5/2014 Abe et al.

FOREIGN PATENT DOCUMENTS

| | | |
|---|---|---|
| JP | 2007-130886 A | 5/2007 |
| JP | 2013-039799 A | 2/2013 |
| JP | 2014-094500 A | 5/2014 |

*Primary Examiner* — Julian Huffman

(74) *Attorney, Agent, or Firm* — Workman Nydegger

(57) ABSTRACT

A printing apparatus includes a supporting member, a printing section, an image capturing section, and a receiver. The supporting member is configured to support a continuous form. The printing section is configured to cause ink to adhere to the continuous form supported by the supporting member, thus performing printing. The image capturing section is disposed in the supporting member, with a gap between the image capturing section and the supporting member. The image capturing section is configured to capture an image of the continuous form. The receiver is configured to receive ink. The receiver is disposed below the gap.

6 Claims, 5 Drawing Sheets

PRINTING APPARATUS

BACKGROUND

1. Technical Field

The present invention relates to printing apparatuses.

2. Related Art

Printers (or printing apparatuses) known in the related art cause their recording heads (or printing sections) to eject ink (or liquid) so as to perform printing on a continuous form (or a medium). Among such printers is one that includes an image capturing unit (or an image capturing section) to capture an image of a continuous form, and detects, on the basis of the image captured, a distance by which the continuous form is transported (see, for example, JP-A-2014-94500).

The image capturing unit is fixed to a supporting member configured to support a continuous form. This creates a gap between the supporting member and the image capturing unit. Thus, with the continuous form transported improperly onto the supporting member, for example, ink ejected from a recording head may adhere to the supporting member. Such ink adhesion can lead to ink penetrating the gap between the supporting member and the image capturing unit.

A controller to control the image capturing unit and/or an electric system, for example, may be provided below the supporting member. Thus, penetration of the gap between the supporting member and the image capturing unit with ink or liquid may result in disadvantages.

SUMMARY

An advantage of some aspects of the invention is that it provides a printing apparatus capable of mitigating adverse effects caused by liquid that has adhered to a supporting member and penetrated the gap between the supporting member and an image capturing section.

An aspect of the invention provides a printing apparatus including a supporting member, a printing section, an image capturing section, and a receiver. The supporting member is configured to support a medium. The printing section is configured to cause liquid to adhere to the medium supported by the supporting member, thus performing printing. The image capturing section is disposed in the supporting member, with a gap between the image capturing section and the supporting member. The image capturing section is configured to capture an image of the medium. The receiver is configured to receive the liquid. The receiver is disposed below the gap.

Adhesion of liquid to the supporting member may induce penetration of the gap between the supporting member and the image capturing section with the liquid. According to the above aspect, however, the receiver disposed below the gap receives the liquid. This reduces the possibility that the liquid will flow to a region below the receiver. Consequently, the above aspect mitigates adverse effects resulting from the penetration of the gap between the supporting member and the image capturing section with the liquid, which has adhered to the supporting member.

The image capturing section preferably includes a lens barrel. The receiver is preferably disposed on an outer wall of the lens barrel.

The liquid, which has entered the gap, is likely to flow downward along the outer wall of the lens barrel. To deal with this, the receiver according to this aspect is disposed on the outer wall of the lens barrel. Thus, the liquid is easily received by the receiver.

The image capturing section preferably includes a flow path along which the liquid that has penetrated the image capturing section is guided out of the image capturing section.

According to this aspect, if liquid penetrates the image capturing section, the liquid will be guided out of the image capturing section along the flow path of the image capturing section. Consequently, this aspect of the invention mitigates adverse effects caused by the liquid, which has penetrated the image capturing section.

The printing apparatus preferably further includes a projection on the outer wall of the image capturing section. The receiver is preferably disposed to receive the liquid flowing downward from the projection.

The projection on the outer wall may allow liquid to flow downward from an end of the projection. In this case, however, the receiver according to this aspect receives the liquid flowing downward from the projection. This further reduces the possibility that the liquid will flow to a region below the receiver.

The receiver preferably includes: an absorber to absorb the liquid; and a tray to hold the liquid.

Thus, according to this aspect, liquid will be absorbed by the absorber and held by the tray. This increases the reliability of the receiver to receive liquid.

The image capturing section preferably includes: an emitting portion for emitting light; and a wire having a first end connected to the emitting portion and a second end located below the first end. The receiver is preferably disposed along a route for the wire.

The image capturing section includes the route for the wire. Thus, the liquid, which has penetrated the gap between the supporting member and the image capturing section, may pass along the route for the wire and flow along the wire. To deal with this, the receiver according to this aspect is disposed along the route for the wire. Consequently, the receiver receives the liquid which has flowed along the wire.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printing apparatus according to an embodiment of the invention will be described below with reference to the drawings. The printing apparatus according to this embodiment is, for example, an ink jet printer configured to eject ink onto a medium, thus performing printing. Ink is an example of a liquid. The printer is what is called a serial printer configured to move a printing section in a direction intersecting a medium transporting direction so as to perform printing.

Figure 1:
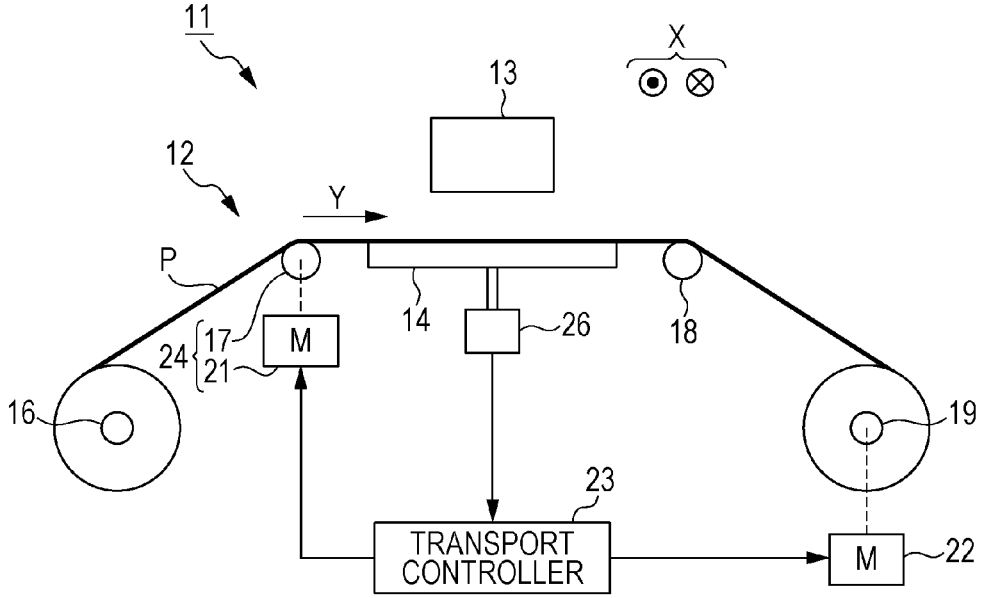
FIG. 1 is a diagram schematically illustrating a printing apparatus according to an embodiment of the invention.

As illustrated in FIG. 1, a printing apparatus 11 includes: a transporter 12 to transport a continuous form P; and a printing section 13 to perform printing on the continuous form P transported by the transporter 12. The continuous form P is an elongated sheet, which is an example of a medium.

The transporter 12 includes a supporting member 14 for supporting the continuous form P. The supporting member 14 is disposed to face the printing section 13, with a transport path for the continuous form P located between the supporting member 14 and the printing section 13. The transporter 12 further includes a feed shaft 16, a transport roller 17, a relay roller 18, and a winding shaft 19. The feed shaft 16 and the transport roller 17 are upstream of the supporting member 14 in a transporting direction Y. In FIG. 1, the feed shaft 16 and the transport roller 17 are leftward of the supporting member 14 in the transporting direction Y. The relay roller 18 and the winding shaft 19 are downstream of the supporting member 14 in the transporting direction Y. In FIG. 1, the relay roller 18 and the winding shaft 19 are rightward of the supporting member 14 in the transporting direction Y.

The transporter 12 further includes: a transport motor 21 to rotate the transport roller 17; and a winding motor 22 to rotate the winding shaft 19. The transporter 12 further includes a transport controller 23 configured to drive the transport motor 21 and the winding motor 22 so as to control transport of the continuous form P. In this embodiment, the transport roller 17, and the transport motor 21, which is a driving source for the transport roller 17, constitute a transport section 24 configured to transport the continuous form P in the transporting direction Y.

The continuous form P is wound into a roll in advance. The continuous form P in this state is rotatably supported by the feed shaft 16. The continuous form P is wound around the transport roller 17 and the relay roller 18. An end of the continuous form P downstream in the transporting direction Y is wound around the winding shaft 19. Thus, driving the transport motor 21 and the winding motor 22 causes the continuous form P to be transported from an upstream position to a downstream position in the transporting direction Y and to be wound up around the winding shaft 19.

The printing section 13 ejects ink while reciprocating in a width direction X intersecting (for example, perpendicular to) the transporting direction Y, thus allowing the ink to adhere to the continuous form P supported by and at rest on the supporting member 14. In other words, the printing apparatus 11 performs printing by alternately causing the printing section 13 to perform printing in the width direction X and transporting the continuous form P in the transporting direction Y.

The supporting member 14 is provided with an image capturing section 26 configured to capture an image of the continuous form P. The image capturing section 26 captures an image of the texture of the reverse side of the continuous form P. No printing is to be performed on the reverse side of the continuous form P. The reverse side of the continuous form P is the surface of the continuous form P to be supported by the supporting member 14 and opposite to the front side of the continuous form P. The front side of the continuous form P faces the printing section 13. Printing is to be performed on the front side of the continuous form P. As used herein, the term "texture" refers to characteristics of the continuous form P, such as color, brightness, and irregularities.

The image capturing section 26 performs image processing, such as template matching, on the basis of image data captured, thus obtaining a distance by which the continuous form P is transported in the transporting direction Y. The transport controller 23 controls driving of the transport motor 21 and driving of the winding motor 22 on the basis of the transported distance obtained by the image capturing section 26.

Figure 2:
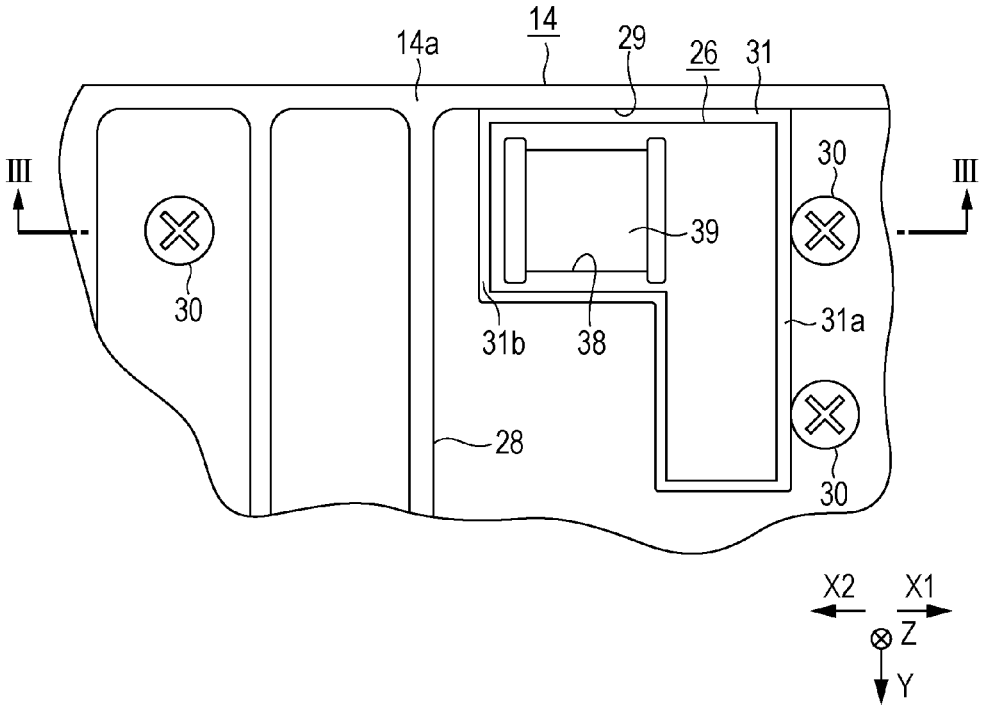
FIG. 2 is a schematic plan view of a supporting member.
Figure 3:
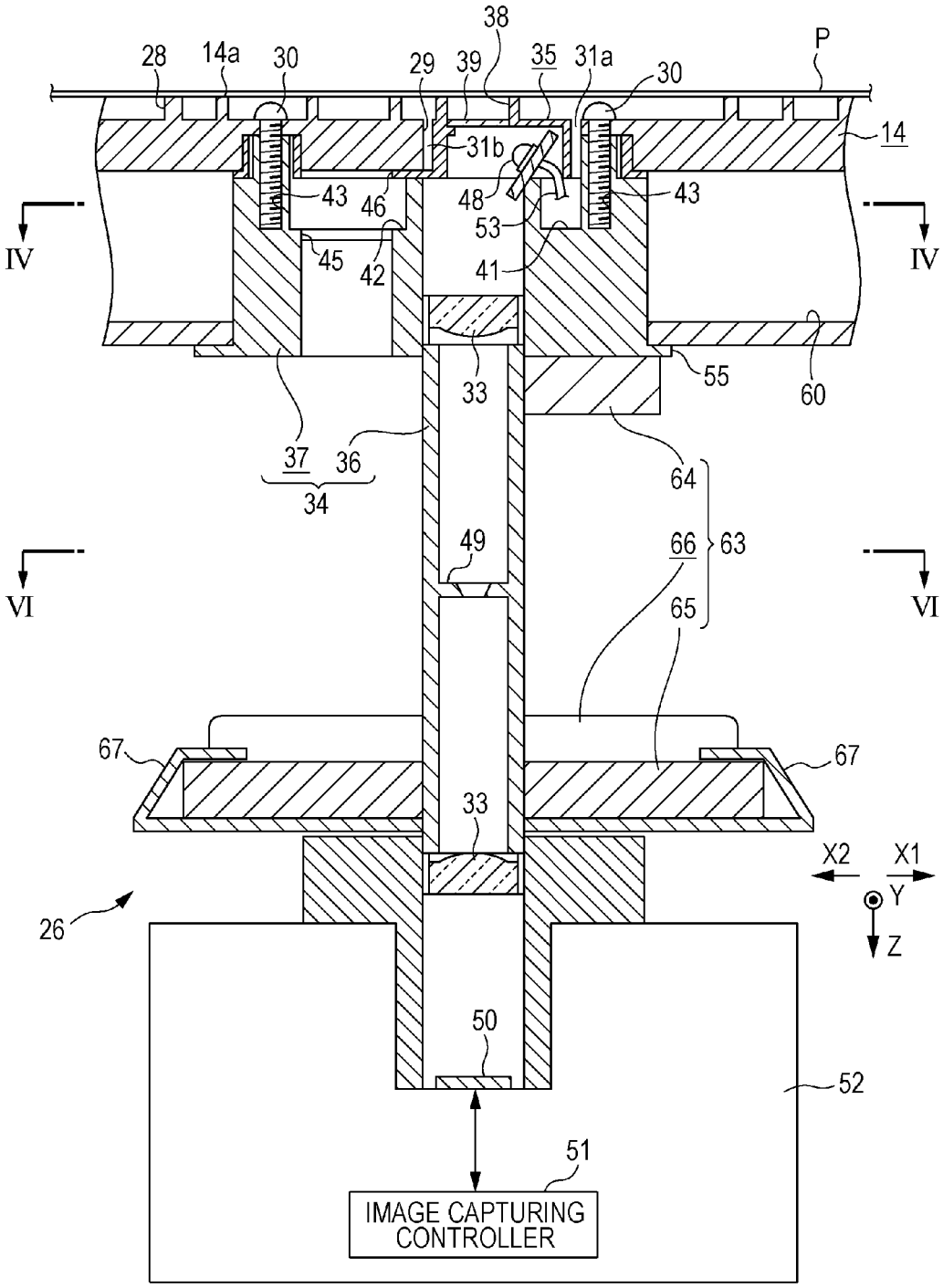
FIG. 3 is a cross-sectional view taken along the line III-III in FIG. 2.

As illustrated in FIGS. 2 and 3, the supporting member 14 includes: a supporting portion 14*a* provided with ribs 28 to support the continuous form P; and a through hole 29 passing through the supporting member 14 so as to be in communication with openings in the supporting portion 14*a*. The length of a portion of the through hole 29 on a first side X1 of the width direction X, measured in the transporting direction Y, is longer than the length of a portion of the through hole 29 on a second side X2 of the width direction X, measured in the transporting direction Y. In FIG. 2, the portion of the through hole 29 on the first side X1 of the width direction X is the right portion of the through hole 29, and the portion of the through hole 29 on the second side X2 of the width direction X is the left portion of the through hole 29.

With the image capturing section 26 partially inserted into the through hole 29 from below, the image capturing section 26 is fixed to the supporting member 14 with at least one screw 30. The image capturing section 26 may be fixed to the supporting member 14 with three screws 30, for example. Thus, a portion of the image capturing section 26 not inserted into the through hole 29 is located below the supporting member 14.

The image capturing section 26 and the supporting member 14 are different components. Thus, the image capturing section 26 is disposed in the supporting member 14 with a gap 31 between the image capturing section 26 and the supporting member 14 (see FIG. 2). The length of the portion of the through hole 29 on the first side X1 of the width direction X, measured in the transporting direction Y, is different from the length of the portion of the through hole 29 on the second side X2 of the width direction X, measured in the transporting direction Y. Accordingly, the length of a portion of the gap 31 on the first side X1 of the width direction X, measured in the transporting direction Y, is also different from the length of a portion of the gap 31 on the second side X2 of the width direction X, measured in the transporting direction Y. Assuming that the gap 31 includes a first gap 31*a* on the first side X1 of the width direction X, and a second gap 31*b* on the second side X2 of the width direction X, the length of the first gap 31*a* measured in the transporting direction Y is longer than the length of the second gap 31*b* measured in the transporting direction Y.

The gap 31 has a visually recognizable width for the sake of clarity in FIGS. 2 and 3, but in reality, the width of the gap 31 between the image capturing section 26 and the supporting member 14 may be such that the space between the image capturing section 26 and the supporting member 14 is sufficient to allow ink to penetrate the gap 31. Thus, if the image capturing section 26 and the supporting member 14 are in contact with each other, the gap 31, which allows ink to penetrate, will be maintained between the image capturing section 26 and the supporting member 14, unless the gap 31 between the image capturing section 26 and the supporting member 14 is closed with a sealant or adhesive, for example.

As illustrated in FIG. 3, the image capturing section 26 includes: a lens barrel 34 supporting at least one lens 33; and a cover 35 covering an opening in the lens barrel 34. In this embodiment, the lens barrel 34 supports a pair of lenses 33. The lens barrel 34 may also be referred to as a "lens barrel". The lens barrel 34 includes: a tube portion 36 having a length along the optical axis of the lenses 33, or along a downward direction Z in FIG. 2; and an attachment portion 37 having a predetermined block shape. The length of the tube portion 36 is set in accordance with the focal length of the lenses 33. The attachment portion 37 serves to attach the tube portion 36 to the supporting member 14.

The cover 35 is provided with a detection window 38. The detection window 38 is a light transmissive rectangular opening. A light transmissive glass 39 is bonded to the detection window 38 with an adhesive. The light transmissive glass 39 is colorless and transparent so that light is allowed to transmit therethrough. Specifically, the light transmissive glass 39 is fitted into the cover 35, with a gap between the light transmissive glass 39 and the detection window 38 closed with the adhesive. Accordingly, foreign matter, such as paper powder, dust, and ink, is prevented from entering the image capturing section 26 through the gap between the detection window 38 and the light transmissive glass 39.

Figure 4:
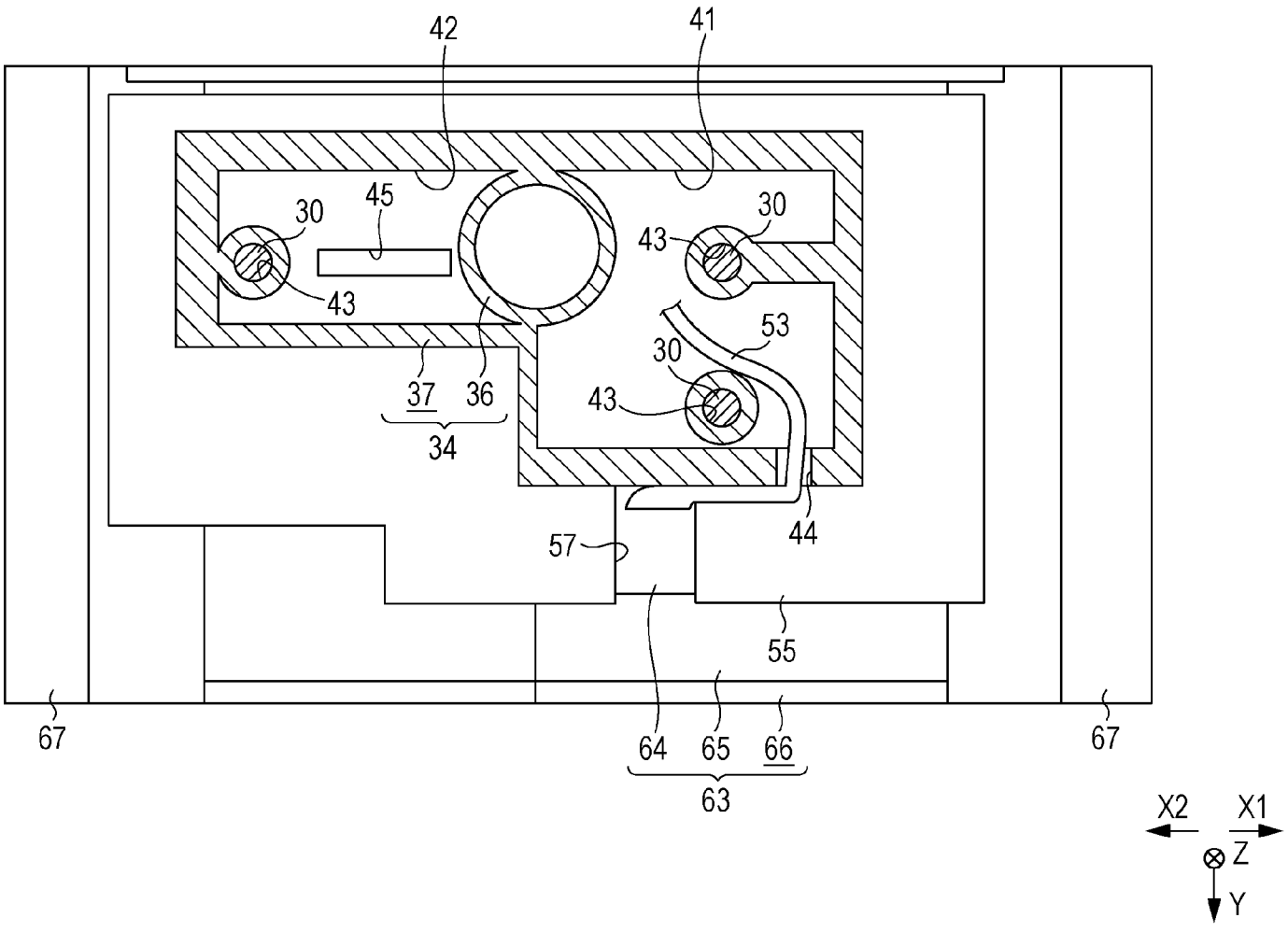
FIG. 4 is a cross-sectional view taken along the line IV-IV in FIG. 3.

As illustrated in FIGS. 3 and 4, the attachment portion 37 of the lens barrel 34 is provided with a first recess 41 and a second recess 42 each covered with the cover 35. The first recess 41 and the second recess 42 are located on opposite sides of the tube portion 36 in the width direction X. Specifically, the first recess 41 is provided on the first side X1 relative to the tube portion 36, and the second recess 42 is provided on the second side X2 relative to the tube portion 36. As illustrated in FIG. 4, the first recess 41 is larger than the second recess 42. The first recess 41 and the second recess 42 are each provided with at least one threaded hole 43 into which the associated screw 30 is to be screwed. The total number of threaded holes 43 may be three, for example.

The attachment portion 37 is provided with a communication hole 44 (see FIG. 4). The communication hole 44 allows the first recess 41 to be in communication with the outside. The bottom surface of the second recess 42 is provided with a first elongated hole 45. A portion of the cover 35 covering the second recess 42 is provided with a second elongated hole 46 (see FIG. 3).

As illustrated in FIG. 3, the image capturing section 26 includes an emitting portion 48 for emitting light. The emitting portion 48 is housed in a housing space defined by the first recess 41 of the lens barrel 34 and the cover 35. The emitting portion 48 is mounted so as to emit light to the light transmissive glass 39 from obliquely below. Specifically, the emitting portion 48 emits light to the continuous form P, which is supported by the supporting member 14, from obliquely below through the light transmissive glass 39. The emitting portion 48 includes a light-emitting diode (LED) and/or a laser diode (LD), for example.

The tube portion 36 contains: a pair of the lenses 33 having a spacing therebetween along the optical axis; an iris 49 located between the lenses 33; and an image capturing element 50 to detect light collected by the lenses 33, i.e., an image formed by the lenses 33. The image capturing element 50 is provided at an end of the tube portion 36 opposite to the cover 35 (i.e., at the lower end of the tube portion 36 in this embodiment). The image capturing element 50 is an area image sensor, such as a CMOS sensor. The image capturing element 50 detects light emitted from the emitting portion 48 and reflected by the continuous form P.

The image capturing section 26 further includes: an image capturing controller 51 to control the emitting portion 48 and the image capturing element 50; a casing 52 housing the image capturing controller 51; and a wire 53 connecting the emitting portion 48 and the image capturing controller 51 to each other. The image capturing controller 51 causes the emitting portion 48 to emit light at regular time intervals and obtains image data from the image capturing element 50 in accordance with the timing of the light emission of the emitting portion 48.

The image capturing controller 51 is disposed below the emitting portion 48. The wire 53 has a first end connected to the emitting portion 48 and a second end connected to the image capturing controller 51. Thus, the second end of the wire 53 is located below the first end of the wire 53.

Figure 5:
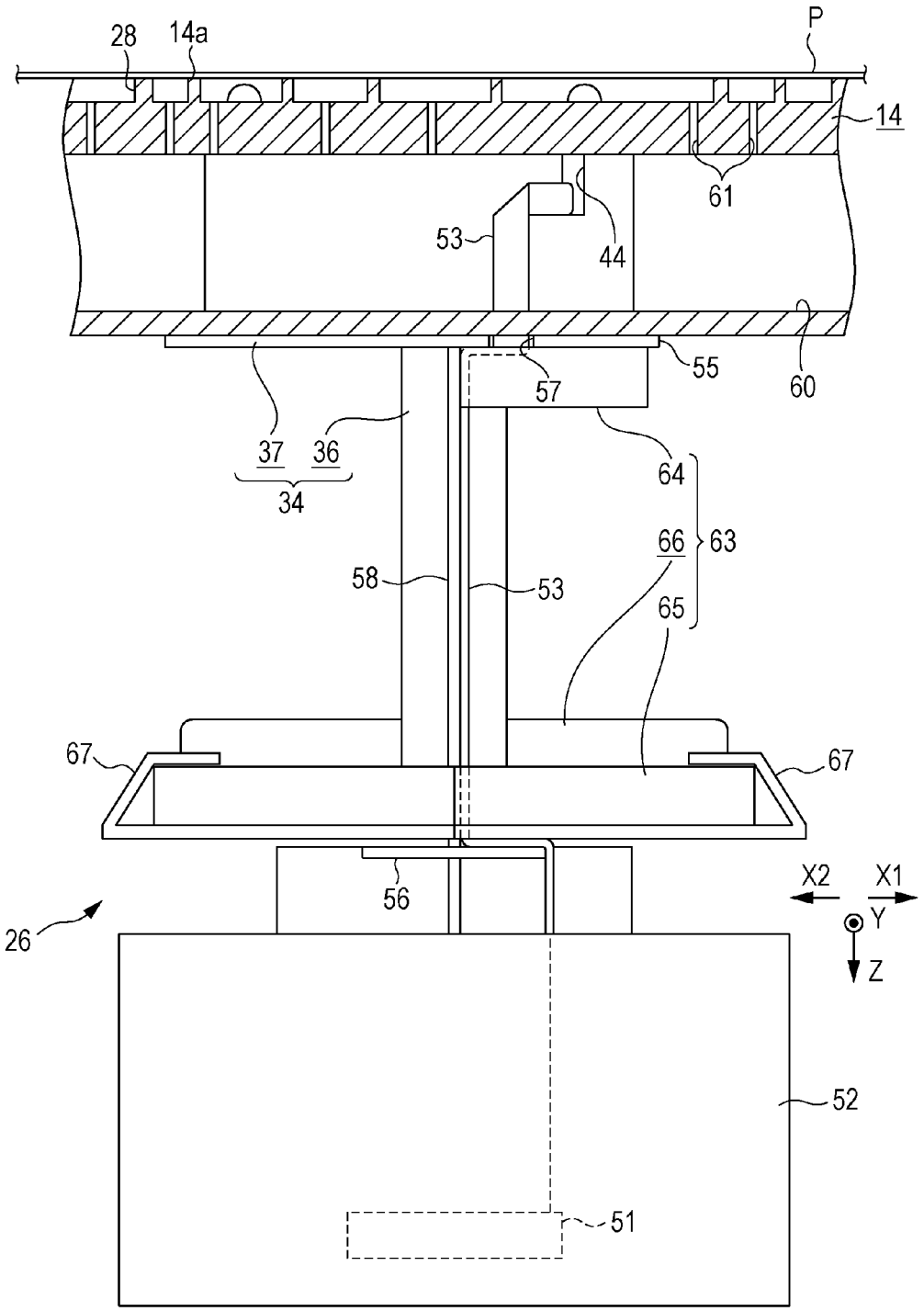
FIG. 5 is a schematic side view of an image capturing section.

As illustrated in FIG. 5, the lens barrel 34 is provided at its outer wall with a collar projection 55 surrounding the attachment portion 37. The projection 55 is located on the lower end of the attachment portion 37. An end of the tube portion 36 located below the projection 55 (i.e., the lower end of the tube portion 36 in FIG. 5) is provided with a flange 56. The projection 55 is provided with a cutout 57. The tube portion 36 is provided with a protrusion 58 extending along the optical axis (i.e., the downward direction Z).

The supporting member 14 contains a negative pressure chamber 60. The negative pressure chamber 60 is placed under negative pressure by driving a suction fan (not illustrated). The supporting member 14 is provided with suction holes 61 through which the negative pressure chamber 60 is in communication with recesses in the supporting portion 14*a*. Each of these recesses is provided between the adjacent ribs 28. Thus, placing the negative pressure chamber 60 under negative pressure causes the continuous form P on the ribs 28 to be sucked by the supporting portion 14*a* through the suction holes 61. The image capturing section 26 is mounted such that the projection 55 is in close contact with the negative pressure chamber 60 via a seal (not illustrated).

The routing of the wire 53 will be described below.

As illustrated in FIGS. 3 and 4, the wire 53 connected to the emitting portion 48 is routed through the first recess 41 while being kept away from the threaded holes 43 and is routed out of the lens barrel 34 through the communication hole 44.

Figure 6:
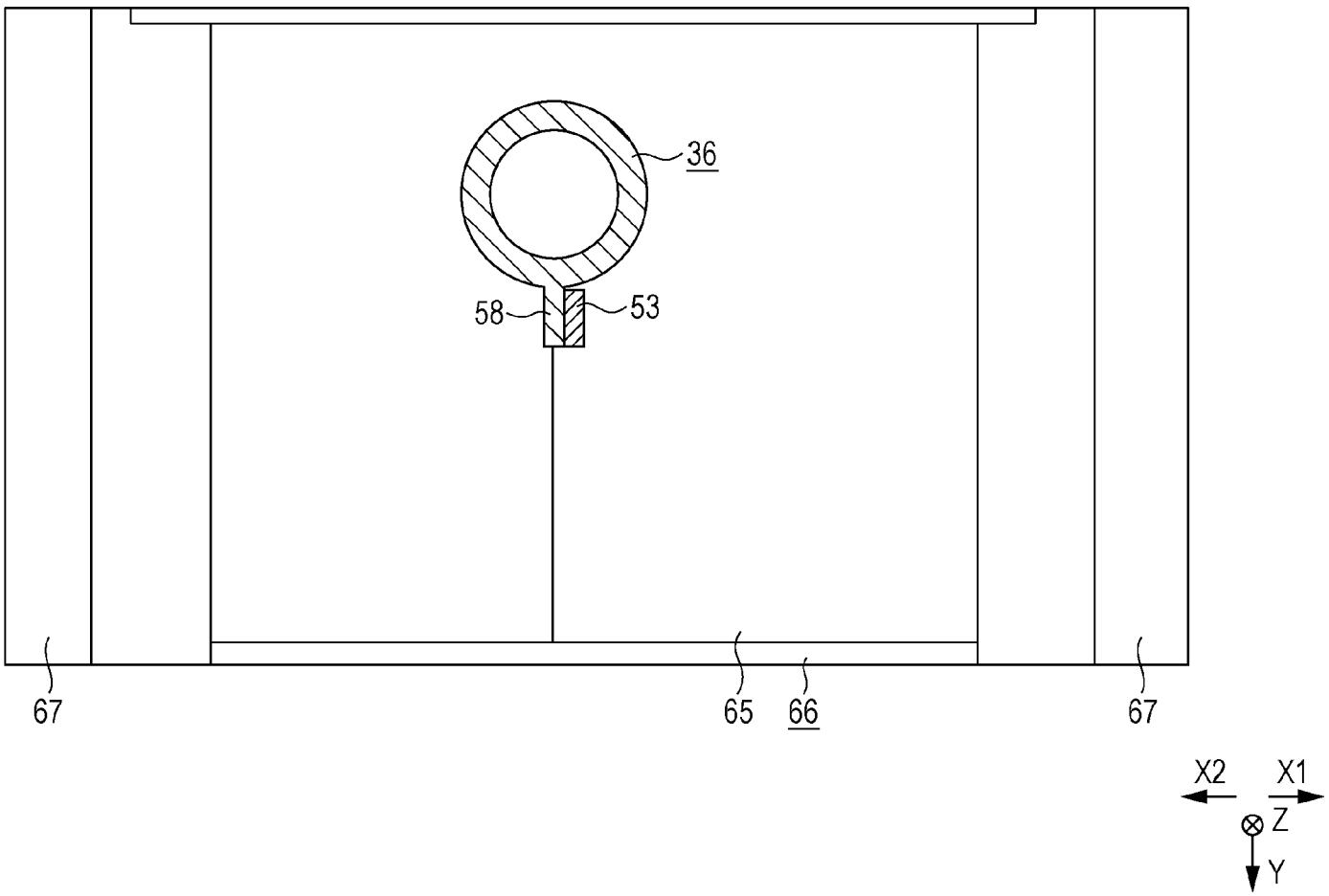
FIG. 6 is a cross-sectional view taken along the line VI-VI in FIG. 3.

As illustrated in FIGS. 5 and 6, the wire 53, which is routed out of the lens barrel 34 through the communication hole 44, runs through the cutout 57 and is bonded to the protrusion 58. The wire 53 is bent along the flange 56 and is then brought into the casing 52 and connected to the image capturing controller 51. Accordingly, the wire 53 is routed to run through the first recess 41, the communication hole 44, and the cutout 57 in the projection 55, and along the protrusion 58 and the flange 56.

A receiver 63 to receive ink will be described below.

As illustrated in FIGS. 3 and 5, the receiver 63 is provided along a route for the wire 53 located below the gap 31 between the supporting member 14 and the image capturing section 26. The receiver 63 includes: a first absorber 64 to absorb ink; a second absorber 65 to absorb ink; and a tray 66 to hold ink.

The first absorber 64 is bonded from below to a portion of the projection 55 provided with the cutout 57. In other words, the first absorber 64 is provided on the lower surface of the attachment portion 37 serving as a portion of the outer wall of the lens barrel 34.

As illustrated in FIGS. 5 and 6, the second absorber 65 and the tray 66 are provided on a portion of the outer wall of the lens barrel 34 (or more specifically, the peripheral surface of the tube portion 36) located below the first absorber 64, such that the second absorber 65 and the tray 66 surround the tube portion 36 of the lens barrel 34. The second absorber 65 is larger than the first absorber 64. Thus, the second absorber 65 is capable of absorbing a larger amount of ink than the first absorber 64. The tray 66 is provided so as to be brought into contact with the second absorber 65 from below. The tray 66 includes inclined surfaces 67 bent so that the ends of the tray 66 in the width direction X cover the lateral surfaces of the second absorber 65.

As illustrated in FIG. 4, the length of the projection 55 from the attachment portion 37 measured in the transporting direction Y is shorter than each of the lengths of the second absorber 65 and the tray 66 measured in the transporting direction Y. This means that the receiver 63 is provided below the projection 55 on the outer wall of the image capturing section 26 and has a size large enough to receive ink flowing downward (or dripping) from the projection 55. The second absorber 65 and the tray 66 are each provided below the first elongated hole 45 in the second recess 42, and each have a size large enough to receive ink flowing downward from the first elongated hole 45.

The following description describes operation of the printing apparatus 11 when printing is performed, with the continuous form P improperly transported onto the supporting member 14.

Suppose that the printing section 13 performs printing with the continuous form P not set on the transporter 12, for example. In this case, ink ejected from the printing section 13 adheres to the supporting portion 14*a* of the supporting member 14 and/or the cover 35 of the image capturing section 26. Because the gap 31 is provided between the supporting member 14 and the image capturing section 26, the ink, which has adhered to the supporting member 14 and/or the image capturing section 26, may penetrate the image capturing section 26 through the gap 31.

As illustrated in FIG. 3, the first recess 41 is located below the first gap 31*a*. Thus, ink that has penetrated the first gap 31*a* will be received by the first recess 41 and will flow out of the image capturing section 26 through the communication hole 44 in the first recess 41. Accordingly, the first recess 41 functions as an exemplary flow path along which the ink, which has penetrated the image capturing section 26, is guided out of the image capturing section 26.

As illustrated in FIG. 5, the wire 53, routed out through the communication hole 44, is routed along the outer wall of the lens barrel 34. Thus, the ink, which has flowed out of the image capturing section 26 through the communication hole 44, flows downward along the wire 53 and/or the outer wall of the lens barrel 34. Although the projection 55 is in close contact with the negative pressure chamber 60, the wire 53 is passed through the cutout 57. This allows ink to flow downward along the route for the wire 53. Because the first absorber 64 is provided on the lower surface of the projection 55, the first absorber 64 absorbs ink flowing downward along the wire 53. The second absorber 65 and the tray 66 receive ink that has not been absorbed by the first absorber 64 and has flowed further downward, and/or ink flowing downward (or dripping) from an end of the projection 55.

As illustrated in FIG. 3, ink that has entered the second gap 31*b* then penetrates the image capturing section 26 through the second elongated hole 46 in the cover 35 and is received by the second recess 42. The ink, which has penetrated the image capturing section 26, flows out of the image capturing section 26 through the first elongated hole 45 in the second recess 42. Accordingly, the second recess 42 functions as an exemplary flow path along which the ink, which has penetrated the image capturing section 26, is guided out of the image capturing section 26. The ink, which has flowed downward from the second recess 42, drips or flows further downward along the wall of the lens barrel 34 and is then received by the second absorber 65 and the tray 66.

The above-described embodiment achieves the effects described below.

1. Adhesion of ink to the supporting member 14 may induce penetration of the gap 31 between the supporting member 14 and the image capturing section 26 with the ink. In this case, however, the receiver 63 disposed below the gap 31 receives the ink. This reduces the possibility that the ink will flow to a region below the receiver 63. Consequently, the above-described embodiment mitigates adverse effects resulting from the penetration of the gap 31 between the supporting member 14 and the image capturing section 26 with the ink, which has adhered to the supporting member 14.

2. The ink, which has entered the gap 31, is likely to flow downward along the outer wall of the lens barrel 34. To deal with this, the receiver 63 is disposed on the outer wall of the lens barrel 34. Thus, the ink is easily received by the receiver 63.

3. If the ink penetrates the image capturing section 26, the ink will be guided out of the image capturing section 26 through the first recess 41 or the second recess 42 of the image capturing section 26. This accordingly mitigates adverse effects caused by the ink, which has penetrated the image capturing section 26.

4. The projection 55 on the outer wall may allow ink to flow downward from an end of the projection 55. In this case, however, the receiver 63 receives the ink flowing downward from the projection 55. This further reduces the possibility that the ink will flow to a region below the receiver 63.

5. The first absorber 64 and the second absorber 65 each absorb ink, and in addition, the tray 66 holds ink. This increases the reliability of the receiver 63 to receive ink.

6. The image capturing section 26 includes the route for the wire 53. Thus, the ink, which has penetrated the gap 31 between the supporting member 14 and the image capturing section 26, may pass along the route for the wire 53 and flow along the wire 53. To deal with this, the receiver 63 is disposed along the route for the wire 53. Consequently, the receiver 63 receives the ink, which has flowed along the wire 53.

7. The tray 66 includes the inclined surfaces 67. Thus, when the tray 66 is assembled to the image capturing section 26 using, for example, a small space, the tray 66 is guided by the inclined surfaces 67. For example, suppose that the image capturing section 26 is assembled to the supporting member 14, with the tray 66 attached to the image capturing section 26. In this case, the tray 66 is guided by the inclined surfaces 67, thus easily positioning the image capturing section 26.

8. The lens barrel 34 includes the projection 55. Thus, the area where the lens barrel 34 is engaged with the negative pressure chamber 60 is larger than when no projection 55 is provided. Accordingly, the negative pressure chamber 60 is more hermetically sealed, because the image capturing section 26 includes the projection 55.

9. The first gap 31*a* is longer than the second gap 31*b* in the transporting direction Y. This means that adhesion of ink to the supporting member 14 makes it likely for the ink to penetrate the image capturing section 26 through the first gap 31*a* rather than the second gap 31*b*. The first absorber 64 is provided along a flow path for the ink, which has penetrated the first gap 31*a* and flows downward therefrom. Thus, the first absorber 64 absorbs the ink. The second absorber 65 is provided along both of the flow path for the ink, which has penetrated the first gap 31*a* and flows downward therefrom, and a flow path for the ink, which has penetrated the second gap 31*b* and flows downward therefrom. Thus, the second absorber 65 absorbs the ink. Accordingly, a plurality of absorbers, i.e., the first absorber 64 and the second absorber 65, are provided along the flow path for the first gap 31*a*, which ink is likely to penetrate. This arrangement increases the reliability of the receiver 63. As used herein, the term "flow path for ink" refers to a path along which ink flows. In the above embodiment, a portion of the wall surface of the lens barrel 34 serves as a flow path along which ink flows downward.

10. The receiver 63 is provided on the outer wall of the lens barrel 34. Thus, the receiver 63 is provided more easily than when the receiver 63 is provided inside the lens barrel 34, for example, inside the first recess 41.

11. For example, using a sealant that will conform to the shape of the gap 31 or using a solidifiable fluid (for example, an adhesive) enables the gap 31 to be closed. To provide such a sealant, however, a mold has to be made. The use of a solidifiable fluid makes it necessary to expel volatilized solvent and harden the fluid, which require time and effort. To eliminate such disadvantages, the gap 31 is closed with no sealant or solidifiable fluid in the above embodiment. Although ink may penetrate the image capturing section 26 through the gap 31, the receiver 63 is configured to receive the ink. Consequently, the image capturing section 26 is assembled to the supporting member 14 more easily than when a sealant, for example, is used.

12. The receiver 63 is provided with the tray 66. This enables dispersion of ink received by the tray 66, thus increasing the area of contact between the second absorber 65 and the ink. Consequently, the ink is efficiently absorbed by the second absorber 65.

The above-described embodiment may include variations as described below.

In the above-described embodiment, the lens barrel 34 may include a retainer, for example, a lug, that retains the receiver 63. In other words, the receiver 63 may be retained by the lens barrel 34. Alternatively, the receiver 63 may be bonded to the lens barrel 34 with an adhesive, for example.

In the above-described embodiment, the receiver 63, provided along the route for the wire 53, may not be in contact with the wire 53. In such a case, the receiver 63 may be away from the wire 53 but still capable of receiving ink flowing along the wire 53.

In the above-described embodiment, the receiver 63 and the route for the wire 53 may be provided at different locations. In this case, an absorber may be provided below the second recess 42, for example, and the absorber may be configured to absorb ink flowing downward from the first elongated hole 45.

In the above-described embodiment, the receiver 63 is required to include at least one of the first absorber 64, the second absorber 65, and the tray 66. The receiver 63 may include a plurality of trays 66 and/or a plurality of absorbers.

In the above-described embodiment, the second absorber 65 may be separate from the tray 66. The second absorber 65 may be provided below the tray 66.

In the above-described embodiment, the image capturing section 26 does not necessarily have to include the projection 55.

In the above-described embodiment, the image capturing section 26 does not necessarily have to include the communication hole 44 and/or the first elongated hole 45. In this case, the first recess 41 and/or the second recess 42, for example, may be configured to receive ink. The image capturing section 26 does not necessarily have to include the first recess 41 and/or the second recess 42.

In the above-described embodiment, the first recess 41 and/or the second recess 42 may be internally provided with rib(s) protruding from the bottom surface(s) of the first recess 41 and/or the second recess 42. When the rib(s) is/are higher than the lateral walls of the first recess 41 and/or the second recess 42, the first recess 41 and/or the second recess 42 function(s) as exemplary flow path(s).

In the above-described embodiment, the receiver 63 may be away from the surface of the outer wall of the lens barrel 34. In this case, the receiver 63 may be provided at a location where ink falls downward from the projection 55, for example.

In the above-described embodiment, the receiver 63 may be provided on the outer wall of the attachment portion 37. Alternatively, the receiver 63 may be provided inside the first recess 41 and/or the second recess 42. The first recess 41 and the second recess 42 may be in communication with each other.

Any liquid that adheres to a medium and thus enables printing on the medium may be used. As used herein, the term "liquid" refers to any substance in the liquid phase. Examples of such a liquid include a low- or high-viscosity liquid, a sol, water gel, and other fluids, such as a non-organic solvent, an organic solvent, a solution, a liquid resin, and a liquid metal (for example, a metal melt). The term "liquid" refers to not only a substance in the liquid phase, but also, for example, a product prepared by dissolving, dispersing, or mixing functional material particles, including a solid such as a pigment or metallic particles, with a solvent. Typical examples of such a liquid include ink. As used herein, the term "ink" refers to various liquid compositions, such as typical water-based and oil-based ink, gel ink, and hot melt ink.

A medium to be used may be paper, resin, metal, cloth, ceramic, rubber, a natural material (for example, wood or stone), or any combination thereof. Such a medium may have a thickness equivalent to that of a plate, a sheet, a film, or foil. The medium may have any shape, such as a rectangular or circular shape. For example, the medium may be a composite film of paper and resin (for example, resin-impregnated paper or resin-coated paper), a composite film (for example, a laminated film) of resin and metal, a woven fabric, a nonwoven fabric, a disk, or a circuit board.

The printing apparatus 11 is an apparatus for printing images, such as characters, pictures, and/or photographs, by causing liquid to adhere to a medium. The printing apparatus 11 may be a serial printer, a lateral printer, a line printer, or a page printer. The printing apparatus 11 may be an offset printer or a textile printer. The printing apparatus 11 is required to have at least the function of performing printing on a medium. The printing apparatus 11 may be a multi-function apparatus having function(s) other than the printing function. The printing apparatus 11 may be an apparatus for performing printing on not only a two-dimensional medium, but also a medium having a three-dimensional curved surface.

The entire disclosure of Japanese Patent Application No. 2015-105428, filed May 25, 2015 is expressly incorporated by reference herein.

What is claimed is:

1. A printing apparatus comprising:

a supporting member for supporting a medium;

a printing section to cause liquid to adhere to the medium supported by the supporting member, thus performing printing;

an image capturing section disposed in the supporting member, with a gap between the image capturing section and the supporting member, the image capturing section being configured to capture an image of the medium; and a receiver to receive the liquid, the receiver being disposed below the gap.

2. The printing apparatus according to claim 1, wherein the image capturing section includes a lens barrel, and wherein the receiver is disposed on an outer wall of the lens barrel.

3. The printing apparatus according to claim 1, wherein the image capturing section includes a flow path along which liquid that has penetrated the image capturing section is guided out of the image capturing section.

4. The printing apparatus according to claim 1, further comprising a projection on the outer wall of the image capturing section, wherein the receiver is disposed to receive liquid flowing downward from the projection.

5. The printing apparatus according to claim 1, wherein the receiver includes:

an absorber to absorb the liquid; and a tray to hold the liquid.

6. The printing apparatus according to claim 1, wherein the image capturing section includes:

an emitting portion to emit light; and a wire having a first end connected to the emitting portion, and a second end located below the first end, and wherein the receiver is disposed along a route for the wire.

* * * * *